US007695788B2

(12) United States Patent
Dal et al.

(10) Patent No.: US 7,695,788 B2
(45) Date of Patent: Apr. 13, 2010

(54) POLYPROPYLENE CONDITIONING PACKAGE

(75) Inventors: Sylvain Dal, Viriat (FR); René Blatter, Commugny (CH)

(73) Assignee: Fromageries Bel, Paris (FR)

( * ) Notice: Subject to any disclaimer, the term of this patent is extended or adjusted under 35 U.S.C. 154(b) by 902 days.

(21) Appl. No.: 10/537,663

(22) PCT Filed: Dec. 3, 2003

(86) PCT No.: PCT/FR03/03577

§ 371 (c)(1),
(2), (4) Date: Jun. 12, 2006

(87) PCT Pub. No.: WO2004/052753

PCT Pub. Date: Jun. 24, 2004

(65) Prior Publication Data

US 2006/0231598 A1 Oct. 19, 2006

(30) Foreign Application Priority Data

Dec. 4, 2002 (CH) ..... 2002 2051/02

(51) Int. Cl.
*B32B 27/32* (2006.01)
*B65B 61/18* (2006.01)
*B65D 17/00* (2006.01)
*B65D 75/00* (2006.01)

(52) U.S. Cl. ..... 428/35.2; 53/412; 229/87.05; 229/87.08; 229/240; 426/122; 426/123; 428/34.1

(58) Field of Classification Search ..... 428/35.2, 428/34.1; 53/412; 229/87.05, 87.08, 240; 426/122, 123
See application file for complete search history.

(56) References Cited

U.S. PATENT DOCUMENTS 3,547,768 A * 12/1970 Layne ..... 428/336

FOREIGN PATENT DOCUMENTS

| | | |
|---|---|---|
| CH | 459 055 | 6/1968 |
| FR | 2 198 469 | 3/1974 |
| FR | 2 362 765 | 3/1978 |
| FR | 2 499 025 | 8/1982 |

OTHER PUBLICATIONS

Machine Translation of FR-2198469 (Mar. 29, 1974).*
Human Translation of FR-2198469 (Mar. 29, 1974).*
Translation of FR 2.198.469, Mar. 29, 1974 (the French document was previously made of record).*

* cited by examiner

*Primary Examiner*—Brent T O'Hern
(74) *Attorney, Agent, or Firm*—Young & Thompson

(57) ABSTRACT

A sealed rectangular parallelepiped polypropylene conditioning package with fast tear-off opening for pasty products likely to melt into a semi-liquid state, in particular cheese, includes a first sheet (1) cut out along a suitable contour and having a rectangular shell-type shape for receiving the product and for providing a gripping corner (2) for opening the package, a cover sheet and two tear-off strips (5,6). The gripping corner (2) has a triangular projection formed on one of the sides of the first sheet cut out into an octagonal shape and the tear-off strips (5, 6) form a pointed U shape whereof the tip is located in the triangular projection, thereby making it easy and simple to open.

13 Claims, 2 Drawing Sheets

POLYPROPYLENE CONDITIONING PACKAGE

This is a 371 National Stage application of International application no. PCT/FR2003/003577, filed Dec. 3, 2003, which claims priority to Swedish application no. 2002 2051/02, filed Dec. 4, 2002. The entire contents of the above-referenced applications are hereby incorporated by reference in their entirety.

The present invention relates to a leakproof package in the form of a rectangular parallelepiped of polypropylene suitable for rapid opening by tearing and for containing a semi-solid product that is capable of being put in a state in which it is at least semiliquid, in particular cheese, the package being made up of two thin sheets, namely a first sheet cut out to an appropriate outline and shaped into a rectangular shell for receiving the product, and so as to present a pull corner for opening the package, and a second sheet cut to at least the dimensions of the bottom of the shell and for placing flat on the product, with the sides of the shell being folded down thereon and heat-sealed, while leaving the pull corner free, and two tear strips disposed on and secured to the first sheet, so as to be entrained when the pull corner is pulled.

BACKGROUND OF THE INVENTION

A package of this type is known from French patent No. FR 2 499 025. In that package, the first sheet is provided with two parallel tear strips and the pull corner is formed by a 45° fold of two halves of one of the sides of the cut-out sheet. The effect of this folding is to be bring the ends of the two tear strips into a heat-sealing zone that is relatively far away from the end of the pull corner. When the pull corner is pulled, there is a danger of tearing the pull corner before exerting traction on the tear strips, and consequently of failing to open the package.

In a package derived from the preceding package, in which the corner is also formed by two 45° folds, the parallel tear strips are closer to the center of the package and present an enlargement towards said center so that they are situated very close to the end of the pull corner while the corner is being formed. However, portions of the sides of the 45° folded corner are heat-sealed onto the second sheet, forming a fold that presents greater resistance to tearing. Such a package, when made out of polyethylene (PP), is very difficult to tear because of this fold, which is why that package is made out of oriented polypropylene (OPP).

French patent No. FR 2 362 765 discloses a package in the form of a rectangular parallelepiped provided with a tear strip in the form of a tuning fork, with a very short handle forming the pull tongue for tearing purposes. It is not easy to take hold of that short tongue.

SUMMARY OF THE INVENTION

An object of the invention is to make it easier to open a package made of polypropylene (whether PP or OPP).

The package of the invention is characterized in that the pull corner is formed by a triangular projection formed on one of the sides of the first sheet cut out into an octagonal shape, and in that the tear strips form a pointed U-shape with the tip thereof being situated in said triangular projection.

Thus, when taking hold of the pull corner, the two tear strips are also taken hold of, and the package can be opened without encountering the resistance of a fold.

Advantageously, the side of the first sheet provided with the pull corner presents two tear starters. The tear starters are advantageously constituted by cuts situated to extend the sides of the pull corner.

The tear strip is advantageously situated inside the shell so as to be hidden, and it extends along the sides of the bottom of the shell so as to enable the package to be opened fully.

To form the shell and to package the product therein, it is possible to use the method and the installation described in Swiss patent No. CH 690 996 (EP 0 803 439), while making the necessary adaptations.

The sides of the first sheet may be folded down onto the second sheet using two different techniques: the sides of the shell situated on either side of the tear strips can be folded down last so as to be folded down onto the other two sides, or first, so as to be folded down under the other two sides.

BRIEF DESCRIPTION OF THE DRAWINGS

An embodiment of the invention is shown by way of example in the accompanying drawings.

DETAILED DESCRIPTION OF THE INVENTION

Figure 1:
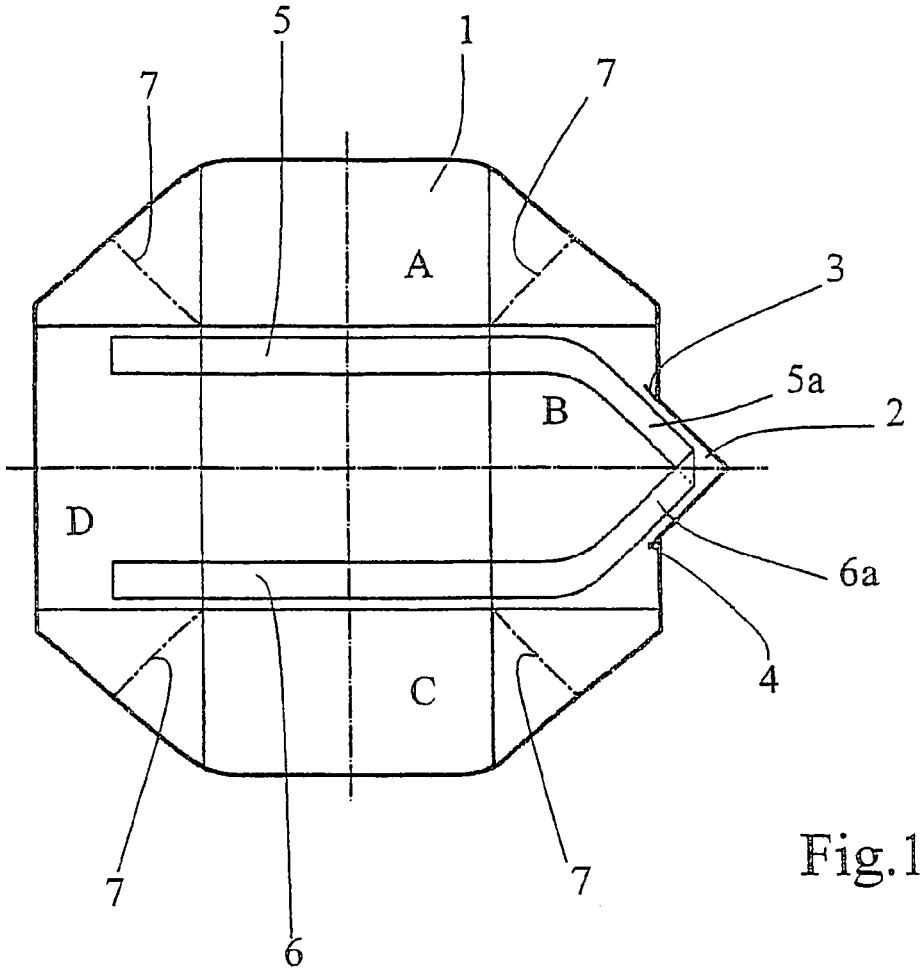
FIG. 1 shows the first sheet as cut out and prior to folding.

FIG. 1 shows a sheet 1 of polypropylene (PP) cut into an almost regular octagonal shape with one of its sides presenting in its middle a projection of triangular shape, with the sides of the triangle being extended by two cuts 3 and 4 extending into the inside of the octagonal surface, these cuts forming tear starters. Two tear strips 5 and 6 made of polyethylene terephthalate (PET) are previously cut to shape and secured to the sheet 1 by heat-sealing so that the angled portions 5*a* and 6*a* of the strips meet in the triangular projection 2. The two tear strips 5 and 6 thus form a pointed U-shape with the tip thereof coinciding approximately with the triangular projection 2. Instead of using two strips 5 and 6, it would naturally be possible to use a single strip cut to a U-shape.

Figure 2:
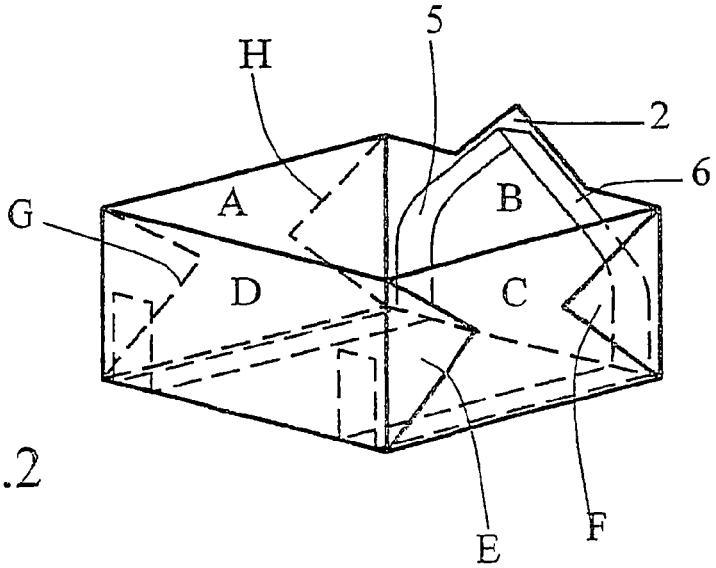
FIG. 2 shows the first sheet formed into a shell ready for receiving the product for packaging.

By means of a mandrel and pushers, for example of the kind described in Swiss patent CH 690 996, the sheet 1 is given the shape of a rectangular parallelepiped, as shown in FIG. 2. The main fold lines are drawn as fine lines in FIG. 1. These fold lines form the side walls A, B, C, and D of the shell. To form the vertical edges of the shell, the portions of the sheet 1 situated between the faces A, B, C, and D are folded along fold lines 7 drawn in chain-dotted lines extending perpendicularly to the corresponding sides of the octagon. Folding about lines 7 and flattening down against the faces A and C serves to form flap portions E, F, G, and H as shown in FIG. 2. This shaping into a shell is performed by stamping in a hot stamping passage in order to hold the folds. The folded-down portions are superposed and heat-sealed.

The shell as shown in FIG. 2 then receives a suitably measured-out quantity of the product for packaging. The shell is thus filled up to only about two-thirds of its height.

Thereafter, a sheet 8 of PP is put into place on the product, the sheet 8 being rectangular or square in shape depending on the folding technique used.

Figure 3:
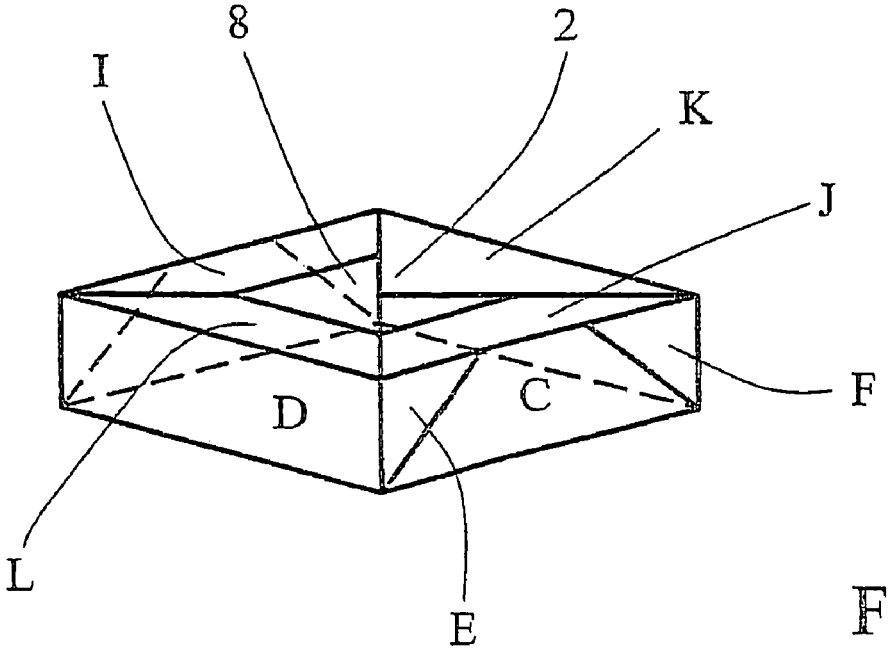
FIG. 3 shows the package finished using a first folding technique.

In the first folding techniques shown in FIG. 3, the second sheet 8 is rectangular. Parallel to the tear strips 5 and 6, its width is equal to the width at the bottom of the shell, its length thus being longer than the sides of the bottom so as to overlie the faces A and C and thus improve sealing. After the sheet 8 has been put into place, those portions of the faces B and D that are situated above the sheet 8 are initially folded into place on the sheet 8, after which the other two faces A and C are folded down. The folded portions I and J thus overlie the folded portions K and L. While this folding down is taking place, the size of the triangular projection 2 is such that its sides extend the 45° sides of the folded-down portions I and J.

Figure 4:
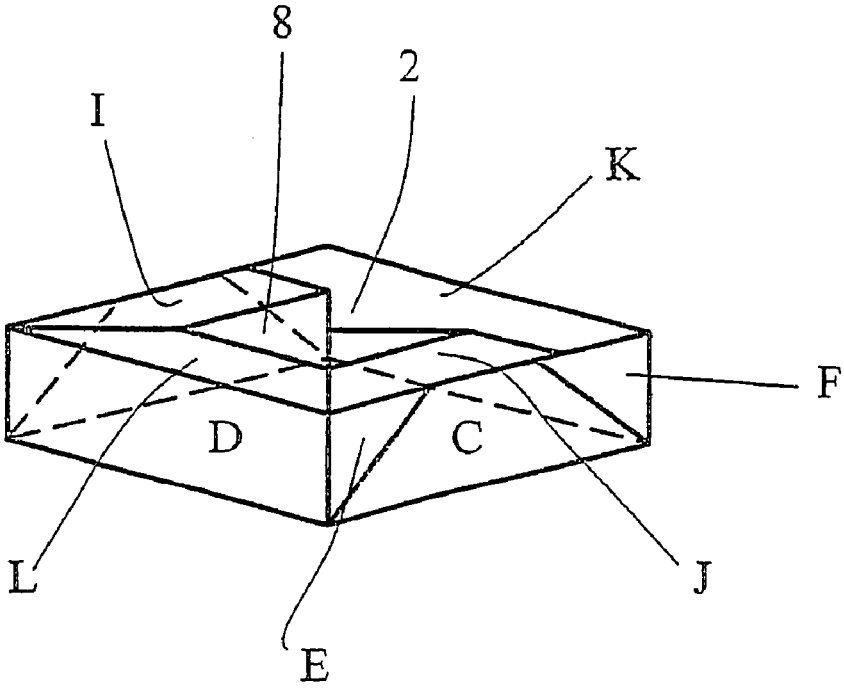
FIG. 4 shows the package finished using a second folding technique.

Nevertheless, it is possible initially to fold down the portions I and J and subsequently the portions K and L. This produces the appearance shown in FIG. 4. Nevertheless, this folding requires the top panels of the flaps F and H to be given an additional 45° fold in order to release a passage for the tear strips 5 and 6.

These folding operations are performed using hot tools so as to ensure that the folds are maintained. The shell and the cover sheet 8 are then heat-sealed in a hot press. The two flaps from the last folding operation are held down flat in a press in order to ensure that they do not unfold under the effect of heat from the cheese, given the memory of the polypropylene film.

During this heat-sealing, at least the end of the triangular projection 2 is left free so as to constitute a corner to be taken hold of and pulled in order to open the package.

The film used could equally well be made of OPP or of PP.

The invention claimed is:

1. A leakproof package in the form of a rectangular parallelepiped of polypropylene suitable for rapid opening by tearing and for containing a semisolid product that is capable of being put in a semiliquid state, in particular cheese, the package being made up of two thin sheets, namely a first sheet cut out to an appropriate outline and shaped into a rectangular shell for receiving the product, and so as to present a pull corner for opening the package, and a second sheet cut to at least the dimensions of the bottom of the shell and for placing flat on the product with the side faces of the shell being folded down thereon, and heat-sealed, while leaving the pull corner free, and two tear strips disposed on and secured to the first sheet, so as to be entrained when the pull corner is pulled, wherein the pull corner is formed by a triangular projection formed on one of the sides of the first sheet cut out into an octagonal shape, and wherein the tear strips form a pointed U-shape with the tip thereof being situated in said triangular projection.

2. A package according to claim 1, wherein the side of the first sheet provided with the pull corner presents two tear starters.

3. A package according to claim 2, wherein the tear starters are constituted by cuts situated to extend the sides of the pull corner.

4. A package according to claim 1, wherein the tear strips are situated inside the shell and extend along two sides of the bottom of said shell.

5. A package according to claim 1, wherein the side faces of the shell situated on either side of the tear strips are folded down onto the folded-down portions of the other two side faces.

6. A package according to claim 1, wherein the side faces extending transversely relative to the tear strips of the shell are folded down onto the folded-down portions of the other two faces.

7. A leakproof rectangular parallelepiped package comprising:

a first sheet of polypropylene in the shape of a rectangular shell having a bottom and four side walls for receiving a product;

a pull corner formed by a triangular projection positioned on one of said side walls of said first sheet, said pull corner being adapted for opening the package;

a second sheet of polypropylene having at least the dimensions of the bottom of the rectangular shell, said second sheet adapted to form a flat cover over said product;

said four side walls being configured so that portions of said walls situated above the second sheet are folded down onto said second sheet and heat-sealed to form said leakproof rectangular parallelepiped package, while leaving the pull corner free; and two tear strips disposed on and secured to said first sheet and configured to form a pointed U-shape with a tip portion positioned in said triangular projection so that when the pull corner is grasped by a user, the two tear strips are also grasped by said user so as to be entrained when the pull corner is pulled to enable rapid opening of said package without encountering resistance of a fold, wherein said package is adapted to contain a semisolid product capable of being put in a semiliquid state.

8. The leakproof rectangular parallelepiped package of claim 7, wherein said side wall provided with said pull corner comprises two tear starters.

9. The leakproof rectangular parallelepiped package of claim 8, wherein each tear starter comprises cuts situated to extend sides of the pull corner.

10. The leakproof rectangular parallelepiped package of claim 7, wherein the tear strips are positioned inside said rectangular shell and extend along two sides of the bottom of said rectangular shell.

11. The leakproof rectangular parallelepiped package of claim 7, wherein the portions of the side walls of the rectangular shell positioned on either side of the tear strips are folded down onto the folded-down portions of the other two side walls.

12. The leakproof rectangular parallelepiped package of claim 7, wherein the portions of the side walls extending transversely relative to the tear strips of the rectangular shell are folded down onto the folded-down portions of the other two side walls.

13. The leakproof rectangular parallelepiped package of claim 7, wherein said semisolid product is cheese.

* * * * *